US009610789B2

(12) United States Patent
Kato

(10) Patent No.: US 9,610,789 B2
(45) Date of Patent: Apr. 4, 2017

(54) RECORDING APPARATUS

(71) Applicant: Seiko Epson Corporation, Tokyo (JP)

(72) Inventor: Junya Kato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/813,450

(22) Filed: Jul. 30, 2015

(65) Prior Publication Data

US 2016/0039231 A1 Feb. 11, 2016

(30) Foreign Application Priority Data

Aug. 7, 2014 (JP) ..... 2014-161034

(51) Int. Cl.
*B41J 15/16* (2006.01)

(52) U.S. Cl.
CPC ..... *B41J 15/16* (2013.01)

(58) Field of Classification Search
CPC ..... B41J 15/16; B41J 15/165
USPC ..... 347/104
See application file for complete search history.

(56) References Cited

U.S. PATENT DOCUMENTS

2004/0179077 A1* 9/2004 Samii ..... B41J 3/4078 347/101
2009/0303276 A1* 12/2009 Van De Wynckel .. B41J 19/205 347/19
2012/0118186 A1* 5/2012 Nishiyama ..... B41F 13/025 101/248

FOREIGN PATENT DOCUMENTS

JP 2003-071360 A 3/2003
JP 2009-143147 A 7/2009
JP 2011-20811 A 2/2011
JP 2013-103448 A 5/2013

* cited by examiner

*Primary Examiner* — Alessandro Amari
*Assistant Examiner* — Michael Konczal
(74) *Attorney, Agent, or Firm* — Workman Nydegger

(57) ABSTRACT

Provided is a recording apparatus which includes a recording portion which can perform recording, a transporting portion which transports a medium by coming into contact with the medium and is provided in an area upstream from the recording portion in a transporting direction of the medium, and a plurality of tension adjusters which are provided in a cross direction crossing the transporting direction and each of which can apply tension to the medium from at least either a recording surface side or a non-recording surface side opposite to the recording surface of the medium.

12 Claims, 10 Drawing Sheets

(PRIOR ART)

RECORDING APPARATUS

BACKGROUND

1. Technical Field

The present invention relates to a recording apparatus.

2. Related Art

Hitherto, recording apparatuses, each of which includes a recording portion which performs recording by, for example, discharging a liquid, such as an ink, on a medium and can record onto the medium, are used. In the recording apparatuses, there is a recording apparatus in which a medium is transported by a transporting portion which comes into contact with the medium and transports the medium and recording can be performed on the medium transported by the transporting portion.

A recording apparatus which includes a unwinding mechanism capable of feeding of a roll-shaped medium, a sending roller and a pinch roller as a sending roller and a pinch roller as a sending roller and a pinch roller as transporting portions which come into contact with the medium and transports the medium, a medium winding mechanism, and a support arm capable of adjustment of tension applied to the medium is disclosed in, for example, JP-A-2009-143147.

However, in a recording apparatus as the apparatus of JP-A-2009-143147, in which a medium is transported by a transporting portion which comes into contact with the medium and transports the medium and recording can be performed on the medium transported by the transporting portion, in some cases, partial deformation, such as wrinkles (in other words, an unevenness), occurs in the medium due to, for example, an aspect of contact between the transporting portion and the medium. When partial deformation occurs in the medium, a distance (in other words, a so-called PG) between the recording portion and the medium is not constant. As a result, in some cases, deviation of a recording position or contact between the recording portion and the medium occurs.

In the recording apparatus of JP-A-2009-143147, for example, the tension applied to the medium is uniformly adjusted by a support arm, in a direction crossing a transporting direction of the medium, in such a manner that deformation due to skewed transporting of the medium can be prevented. However, it is not possible to sufficiently prevent partial deformation due to, for example, an aspect of contact between the transporting portion and the medium.

SUMMARY

An advantage of some aspects of the invention is that, in a recording apparatus, deformation of a medium due to a transporting portion which comes into contact with the medium and transports the medium is removed.

According to an aspect of the invention, there is provided a recording apparatus according to a first aspect of the invention including: a recording portion which can perform recording on a medium transported in a transporting direction; a transporting portion which transports the medium and is provided in an area upstream from the recording portion in the transporting direction of the medium; and a plurality of tension adjusters which are provided in a cross direction crossing the transporting direction and each of which can apply tension to the medium from at least either a recording surface side or a non-recording surface side opposite to the recording surface of the medium.

The recording apparatus may further include a controller which controls application of tension to the medium by the tension adjuster.

In the recording apparatus, the tension adjuster may be capable of coming into contact with or separate from the medium.

In the recording apparatus, the tension adjuster may have a configuration in which a pushing amount of the tension adjuster in a state where the tension adjuster is in contact with the medium and pushes the medium can change.

In the recording apparatus, the tension adjuster may apply tension to the medium from the non-recording surface side.

In the recording apparatus, the tension adjuster may be provided in an area upstream from the transporting portion in the transporting direction.

The recording apparatus may further includes a detecting portion which is located in an area downstream from the transporting portion and upstream from the recording portion in the transporting direction and detects deformation of the medium.

In the recording apparatus, the tension adjuster may be capable of applying tension of various amounts to the medium.

In the recording apparatus may further includes a controller which controls application of tension to the medium by the tension adjuster, and a detecting portion which is located in an area downstream from the transporting portion and upstream from the recording portion in the transporting direction and detects deformation of the medium, in which the tension adjuster may be capable of applying tension of various amounts to the medium, and in which the controller may control an extent of tension applied to the medium by the tension adjuster, in accordance with a detection result of the detecting portion.

In the recording apparatus, the transporting portion may be capable of performing intermittent transporting of the medium subjected to transporting by repeating moving and stopping of the medium, and in which the controller may control the tension adjuster so that the tension adjuster applies tension to the medium at the time of stopping of the medium during the intermittent transporting.

In the recording apparatus, the medium may be transported in a state where tension is applied to the medium in the transporting direction.

According to the invention, deformation of a medium due to a transporting portion which comes into contact with the medium and transports the medium can be prevented in a recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, details of a recording apparatus according to an example of recording apparatus of the invention will be described with reference to the accompanying drawings.

Example 1

See FIGS. 1 to 8

Figure 1:
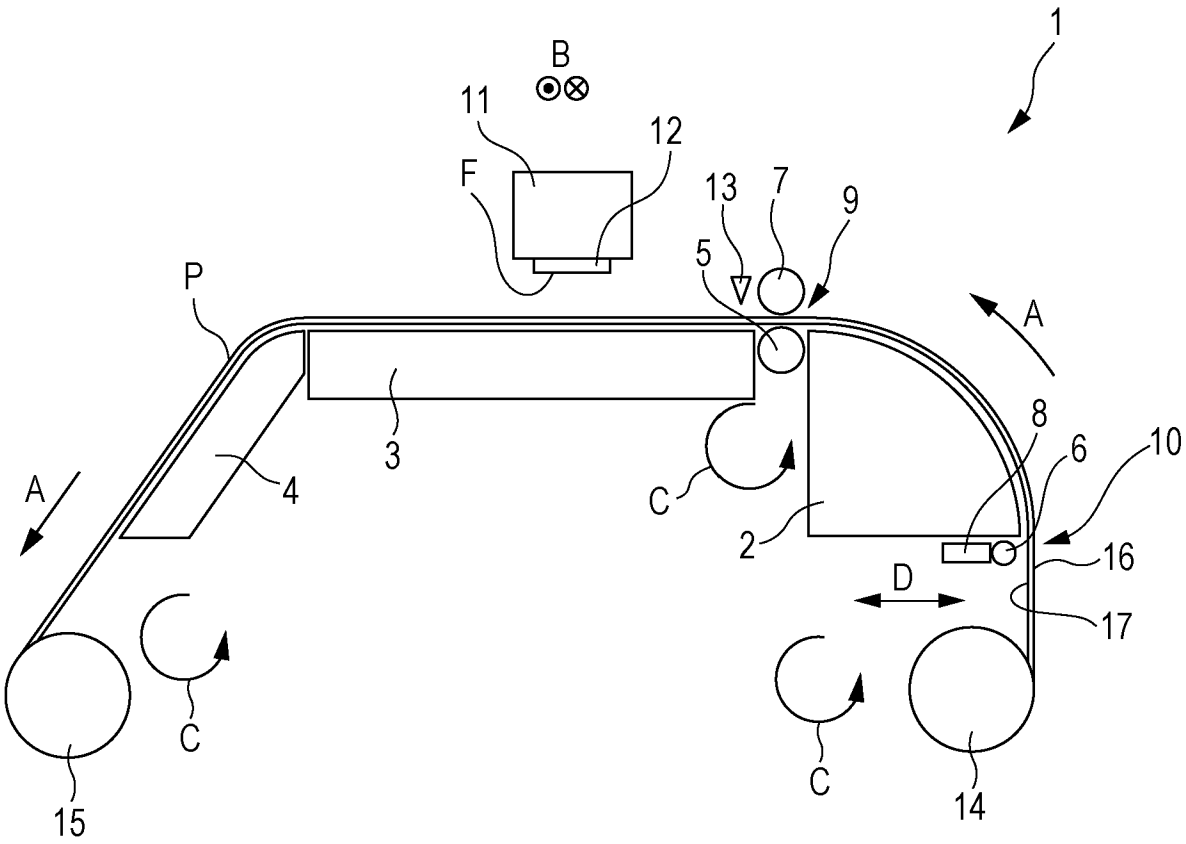
FIG. 1 is a schematic side view illustrating a recording apparatus according to Example 1 of the invention.
Figure 2:
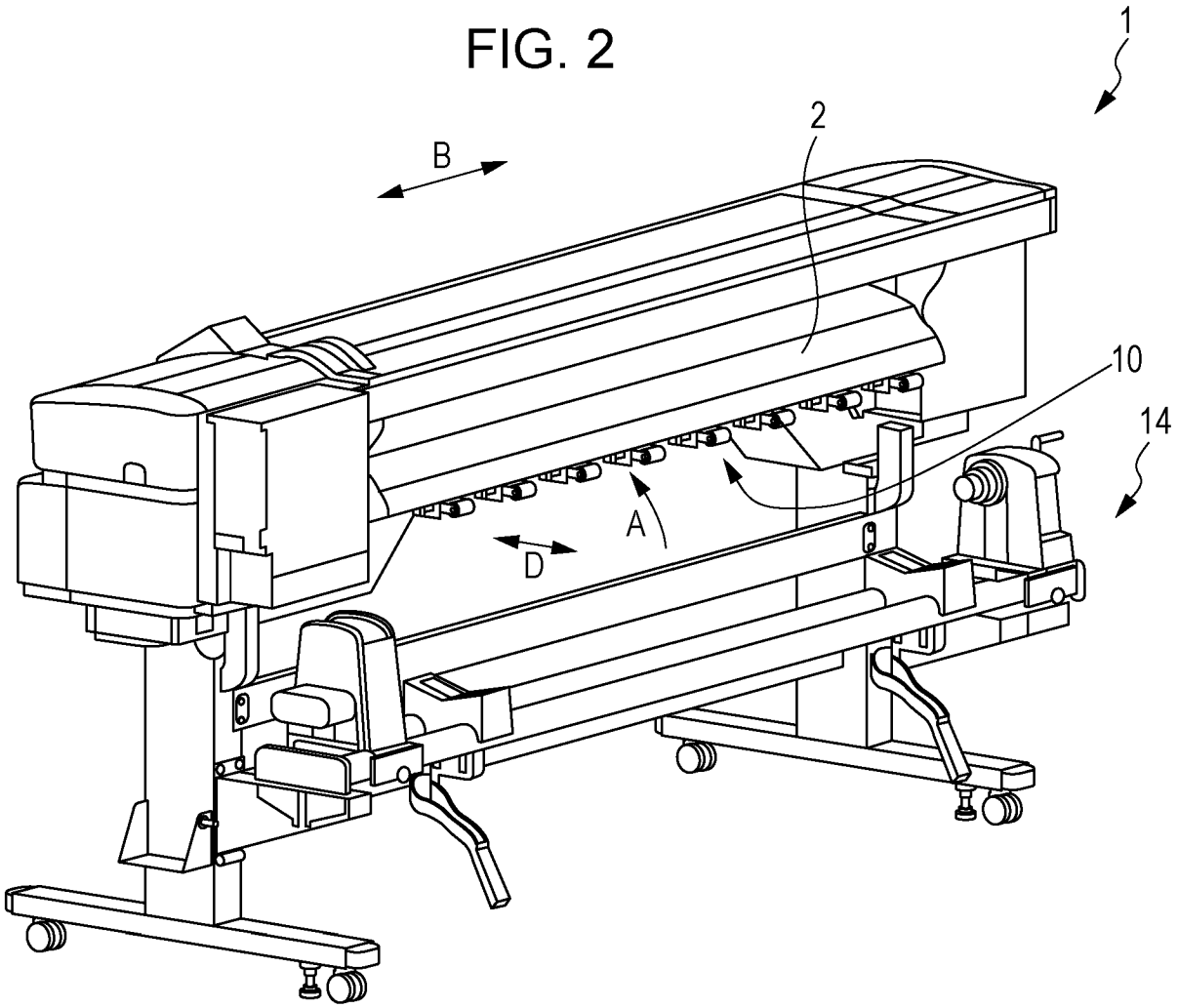
FIG. 2 is a perspective view illustrating the recording apparatus according to Example 1 of the invention.

FIG. 1 is a schematic side view illustrating a recording apparatus 1 of the example. FIG. 2 is a perspective view illustrating the recording apparatus 1 of the example. FIG. 2 is a perspective view of the recording apparatus 1 of the example, when viewed from the rear side. FIG. 2 illustrates the recording apparatus 1 in a state where a winding portion 15 for winding, for example, a recording medium P subjected to recording is removed.

The recording apparatus 1 of the example transports, in a transporting direction A, the recording medium P from a set portion 14 in relation to the recording medium P (in other words, a medium) to the winding portion 15 of the recording medium P, via a platen 2, a platen 3, and a platen 4 which are support portions in relation to the recording medium P, as illustrated in FIG. 1. In other words, in the recording apparatus 1, a path extending from the set portion 14 to the winding portion 15 is a transport path of the recording medium P. The platen 2, the platen 3, and the platen 4 are the support portions in relation to the recording medium P provided in the transport path. Furthermore, the set portion 14 rotates in a rotating direction C and feeds the recording medium P and the winding portion 15 rotates in the rotating direction C and winds the recording medium P. In this case, heaters (not illustrated) are respectively provided in both the platen 2 and the platen 4. Thus, the platen 2 also functions as a so-called pre-heater and the platen 4 also functions as a co-called after-heater.

In the example, the recording medium P of a roll type in which the recording medium P is wound in a state where a recording surface 16 faces outside is used. Accordingly, when the recording medium P is fed from the set portion 14, a rotation shaft of the set portion 14 rotates in the rotating direction C. Meanwhile, when the recording medium P of a roll type in which the recording medium P is wound in a state where the recording surface 16 faces inward is used, a rotation shaft of the set portion 14 rotates in a direction opposite to the rotating direction C, in such a manner that the rotation shaft of the set portion 14 can feed the recording medium P.

Similarly, the winding portion 15 of the example winds the recording medium P so that the recording surface 16 of the recording medium P faces outside. Accordingly, a rotation shaft of the winding portion 15 rotates in the rotating direction C. Meanwhile, when a rotation shaft of the winding portion 15 winds the recording medium P so that the recording surface 16 faces inward, the rotation shaft of the winding portion 15 rotates in a direction opposite to the rotating direction C, in such a manner that the rotation shaft of the winding portion 15 can wind the recording medium P.

In the recording apparatus 1 of the example, a tension adjuster 10 which can apply tension to a surface 17 (in other words, a non-recording surface) of the recording medium P, which is the surface opposite to the recording surface 16, is provided in a portion between the set portion 14 and the platen 2. In this case, a plurality of tension adjusters 10 are provided in a cross direction B crossing the transporting direction A, as illustrated in FIG. 2. Each tension adjuster 10 includes a base portion 8 and a tension roller 6, as illustrated in FIG. 1. The tension roller 6 moves in a direction D in relation to the base portion 8, in such a manner that the tension roller 6 can come into contact with or separate from the recording medium P.

Accordingly, tension adjustment is separately performed by a plurality of tension adjusters 10, in accordance with a position of partial deformation of the recording medium P due to, for example, an aspect of contact between the driven roller 7 described below, the driving roller 5 (in other words, the transporting portion 9), and the recording medium P. As a result, the deformation of the recording medium P due to the driven roller 7 and the driving roller 5 can be prevented by tension adjustment performed separately.

The recording apparatus 1 of the example includes a tension adjuster 10 which can apply tension to the surface 17 side of the recording medium P. However, the recording apparatus 1 may have a configuration in which the tension adjuster 10 which can apply tension to the recording surface 16 side of the recording medium P is provided.

However, the tension adjuster 10 which can apply tension to the surface 17 of the recording medium P, which is the surface opposite to the recording surface 16, is provided, as in the case of the recording apparatus 1 of the example, and thus the tension adjuster 10 can be prevented from coming into contact with the recording surface 16 and damaging the recording surface 16.

Furthermore, in the recording apparatus 1 of the example, a rotation shaft extending in the cross direction B crossing the transporting direction A is provided in a portion between the platen 2 and the platen 3. In addition, a driving roller 5 which applies a sending force to the surface 17 of the recording medium P, which is the surface opposite to the recording surface 16, is provided in the recording apparatus 1 of the example.

A driven roller 7 having a rotation shaft extending in the cross direction B is provided at a position facing the driving roller 5. The driving roller 5 and the driven roller 7 which constitute a pair of rollers can pinch the recording medium P. Accordingly, a transporting portion 9 is constituted of the driving roller 5 and the driven roller 7. In this case, the driven roller means a roller which rotates in accordance with transporting of the recording medium P.

When the recording medium P is transported in the transporting direction A, the driving roller 5 rotates in the rotating direction C and the driven roller 7 rotates in a direction opposite to the rotating direction C.

In this case, when the tension adjuster 10 is provided, in the transporting direction A, in an area downstream from both the driven roller 7 and the driving roller 5, there is a concern that a PG may changes due to, for example, lifting of the recording medium P in accordance with tension applied to the recording medium P by the tension adjuster 10. However, in the recording apparatus 1 of the example, the tension adjuster 10 is provided in an area upstream from both the driven roller 7 and the driving roller 5 in the transporting direction A, as illustrated in FIG. 1. As a result, lifting of the recording medium P is suppressed by, for example, the driven roller 7, in such a manner that a change in the PG can be prevented and the deformation of the recording medium P due to the driven roller 7 and the driving roller 5 is prevented.

However, it may be configured so that the tension adjuster 10 is provided in an area downstream from both the driven roller 7 and the driving roller 5 in the transporting direction A.

Furthermore, a sensor 13 is provided in an area downstream from both the driven roller 7 and the driving roller 5 in the transporting direction A, which is the area on a side facing the platen 3. The sensor 13 can detect deformation, such as wrinkles (in other words, an unevenness) generated in the recording medium P due to, for example, the aspect of contact of both the driven roller 7 and the driving roller 5 in relation to the recording medium P. Furthermore, although details of the configuration will be described below, the recording apparatus 1 of the example includes a controller 23 (see FIG. 8). When sensor 13 detects the deformation of the recording medium P, the position of the deformation of the recording medium P is automatically checked by the controller 23 before the deformed portion reaches the recording head 12. In addition, the controller 23 controls applying of tension to the recording medium P by the tension adjuster 10 of the plurality of tension adjusters 10, which is the tension adjuster 10 corresponding to the detected position of the deformation of the recording medium P. As a result, the deformation of the recording medium P due to the driven roller 7 and the driving roller 5 is automatically smoothed before the deformed portion reaches the recording head 12.

The recording apparatus 1 of the example includes a recording head 12 as a recording portion. The recording head 12 is located in an area downstream from the sensor 13 in the transporting direction A and is disposed on a side facing the platen 3. In the recording apparatus 1, the recording head 12 reciprocates in the cross direction B by a carriage 11 and an ink is discharged onto the recording medium P from a nozzle forming surface F of the recording head 12, in such a manner that a desired image is formed. Accordingly, the recording head 12 as the recording portion can discharge, onto the recording medium P, an ink as a liquid.

Furthermore, the recording apparatus 1 of the example includes the recording head 12 which reciprocates and performs recording. However, the recording apparatus 1 of the example may be a recording apparatus including a so-called line head in which a plurality of nozzles through which the ink is discharged are provided in the cross direction B crossing the transporting direction A.

In this case, the "line head" is a recording head in which an area of nozzles formed in the cross direction B crossing the transporting direction A of the recording medium P can cover the entirety of the recording medium P in the cross direction B and which is used for a recording apparatus in which an image is formed by relatively moving the recording head or the recording medium P. Furthermore, the area of the line head, which is the area having the nozzles aligned in the cross direction B, may not cover the entirety of the recording medium P of all types dealt by the recording apparatus, in the cross direction B.

The recording head 12 of the example is a recording portion which can perform recording by discharging an ink as a liquid on the recording medium P. The recording head 12 is not limited to such a recording portion. For example, a transfer type recording portion which performs recording by transferring coloring materials to the recording medium P may be used as the recording head 12.

Next, a specific configuration of the tension adjuster 10 will be described.

Figure 3:
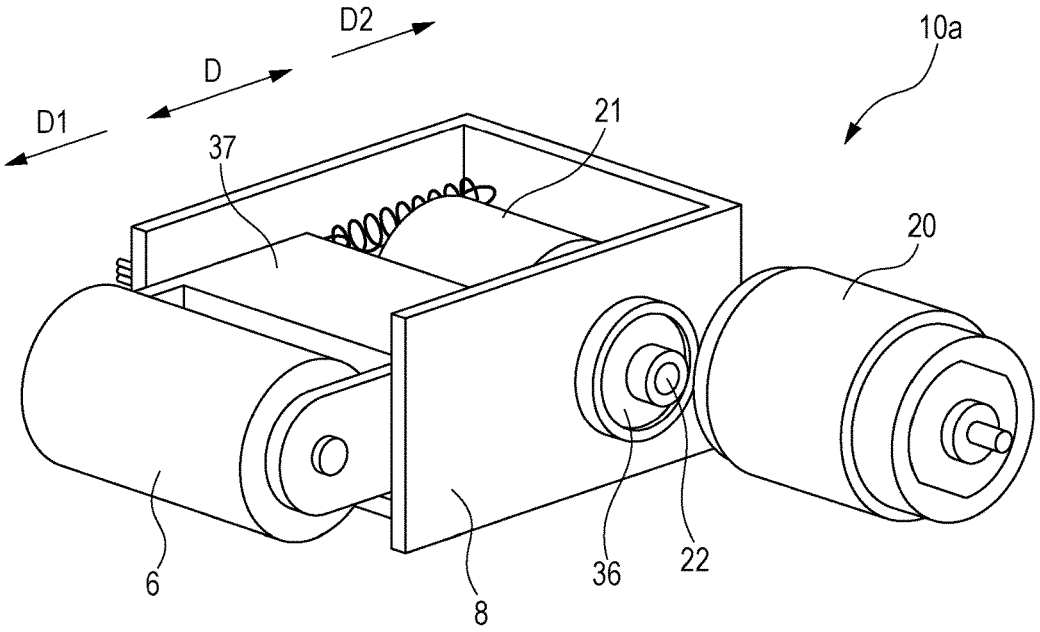
FIG. 3 is a perspective view illustrating a principal portion of the recording apparatus according to Example 1 of the invention.
Figure 4:
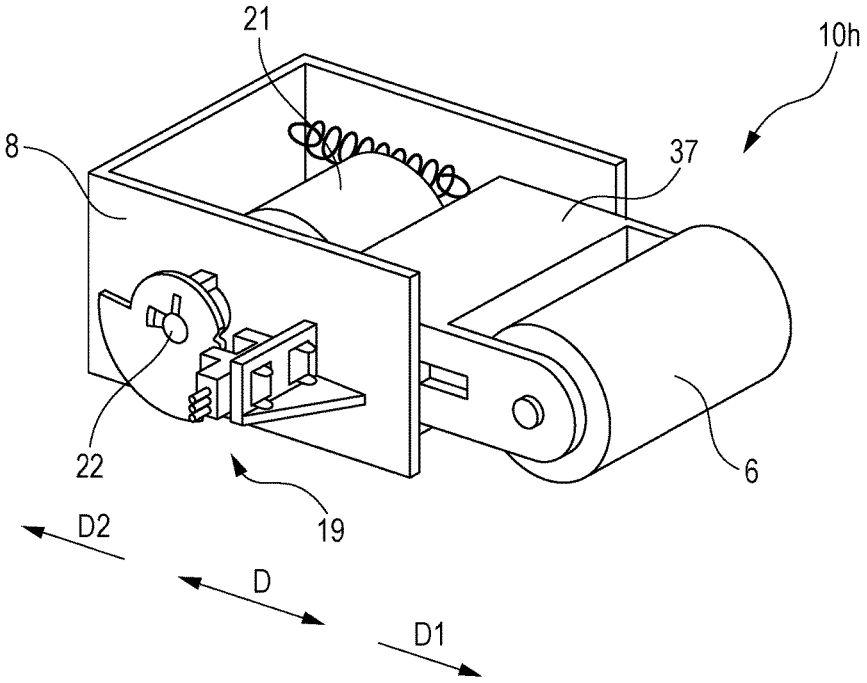
FIG. 4 is a perspective view illustrating a principal portion of the recording apparatus according to Example 1 of the invention.
Figure 5:
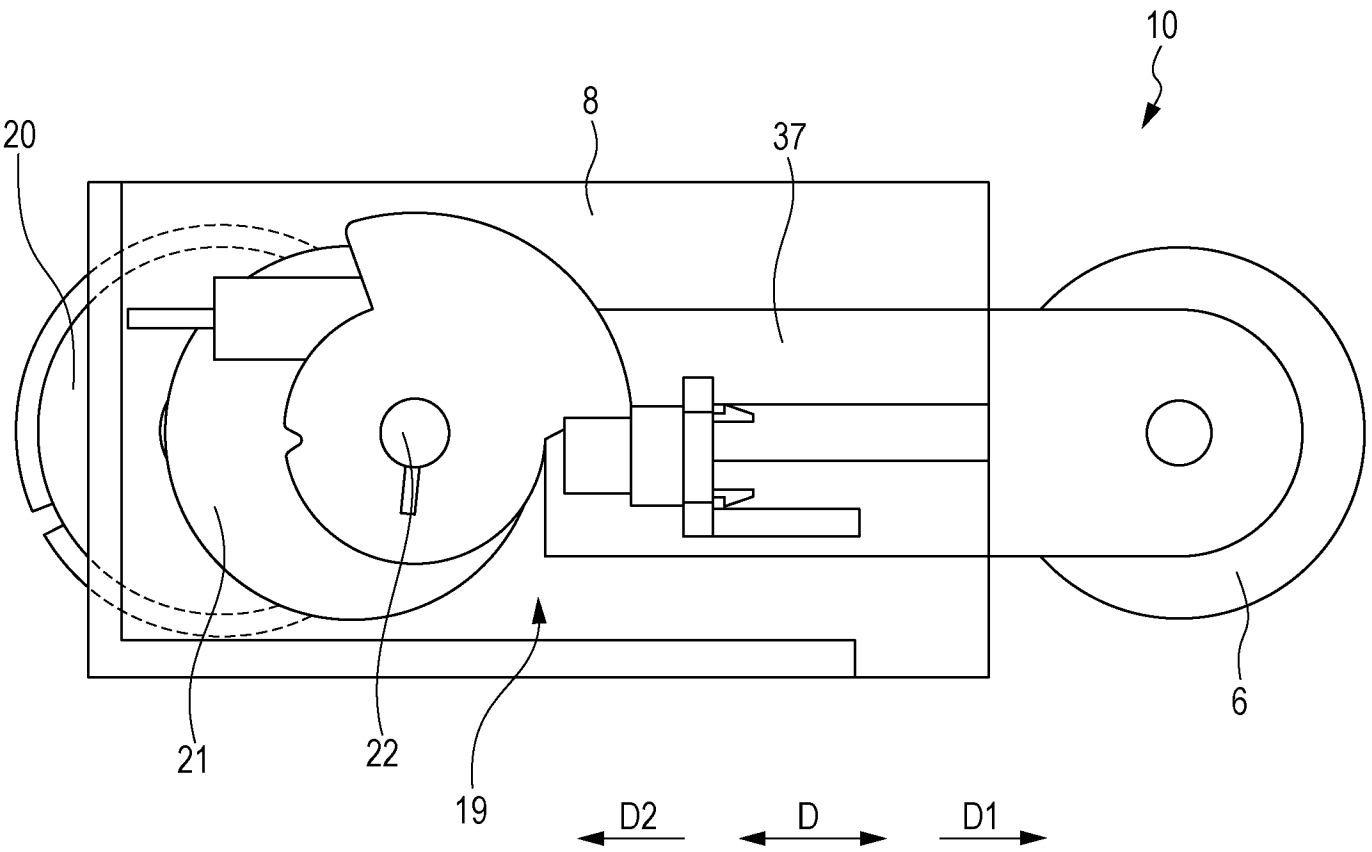
FIG. 5 is a transparent view illustrating a principal portion of the recording apparatus according to Example 1 of the invention, when viewed from a lateral surface side.
Figure 6:
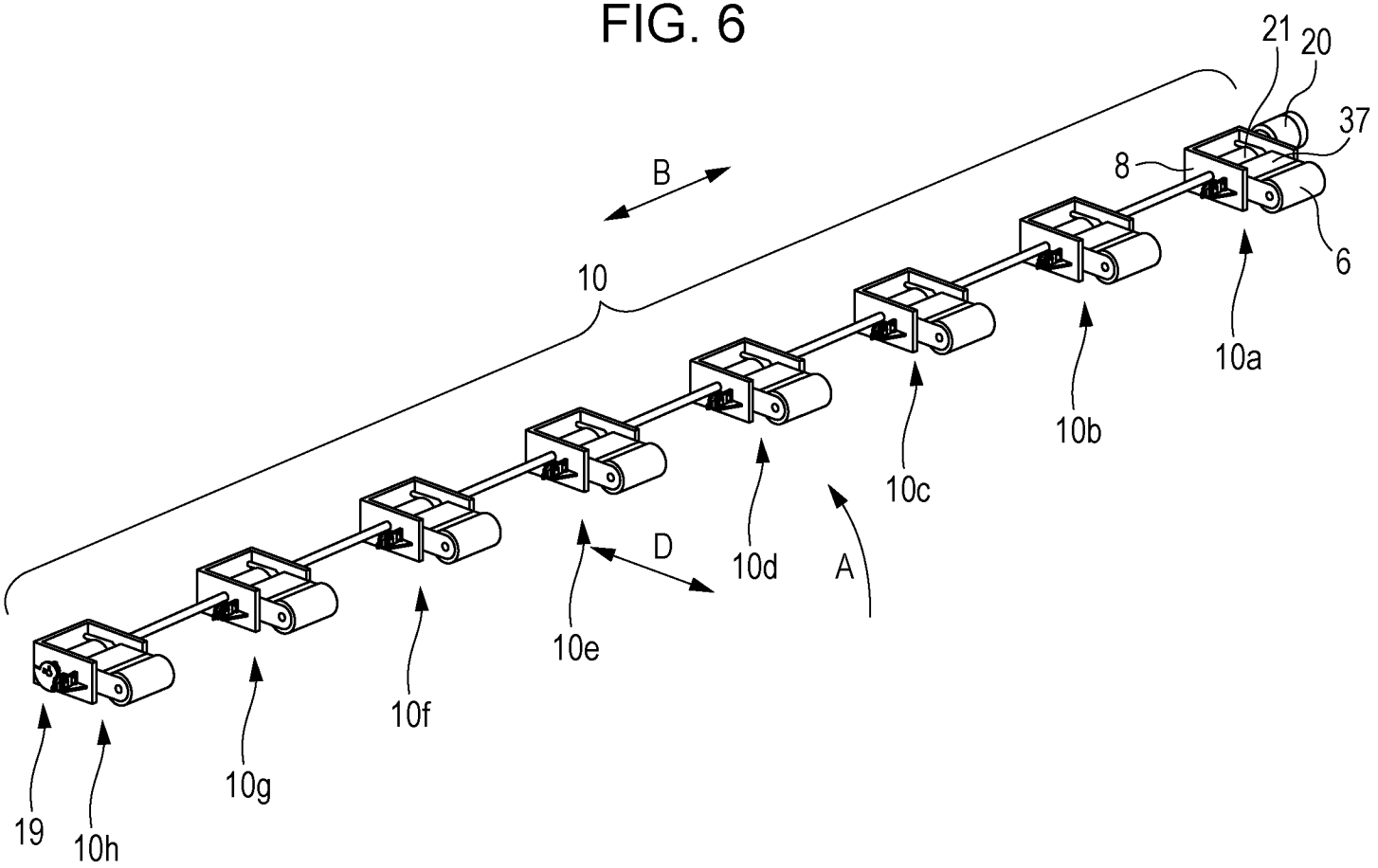
FIG. 6 is a perspective view illustrating a principal portion of the recording apparatus according to Example 1 of the invention.

FIG. 3 is a perspective view illustrating a tension adjuster 10*a* of the tension adjusters 10, which is a principal portion of the recording apparatus 1 of the example. FIG. 4 is a perspective view illustrating a tension adjuster 10*h* of the tension adjusters 10, which is a principal portion of the recording apparatus 1 of the example. FIG. 5 is a transparent view illustrating the tension adjuster 10 of the example, when viewed from a lateral surface side. FIG. 6 is a perspective view illustrating the tension adjuster 10 of the example.

The tension adjuster 10*a* illustrated in FIG. 3 is the tension adjuster 10 of the plurality of the tension adjusters 10 aligned in the cross direction B, which is the tension adjuster 10 on one end portion side. The tension adjuster 10*h* illustrated in FIG. 4 is the tension adjuster 10 of the plurality of the tension adjusters 10 aligned in the cross direction B, which is the tension adjuster 10 on the other end portion side.

The plurality of tension adjusters 10 aligned in the cross direction B are provided in the recording apparatus 1 of the example, as illustrated in FIG. 6. Each tension adjuster 10 includes the base portion 8 and the tension roller 6 which can come into contact with or separate from the recording medium P by moving in the direction D in relation to the base portion 8, as illustrated in FIGS. 3 to 6. In the recording apparatus 1 of the example, the tension adjuster 10 having such a configuration causes the tension roller 6 to be pressed to the surface 17 side of the recording medium P, in such a manner that tension is applied to the recording medium P. As a result, deformation generated in the recording medium P is removed.

The tension roller 6 is supported by a roller support portion 37 which comes into contact with an eccentric cam 21 which eccentrically rotates in accordance with rotation of the a rotation shaft 22. A tension adjustment motor 20 and a rotation portion 36 which can receive a rotation force of the tension adjustment motor 20 are provided on one end portion side of the rotation shaft 22, as illustrated in FIG. 3. Each tension adjuster 10 of the example has such a configuration. Accordingly, the eccentric cam 21 is eccentrically rotated by causing the tension adjustment motor 20 to rotate, and thus the tension roller 6 moves in the direction D in relation to the base portion 8.

Furthermore, when viewed from the cross direction B, the respective tension adjusters 10 are disposed in order in a state where the eccentric cams 21 are deviated by predetermined angles in relation to the rotation shaft 22. In other words, the tension adjuster 10 has such a configuration. Accordingly, in the plurality of the tension adjusters 10, the rotation shafts 22 are rotated, in such a manner that the tension rollers 6 move in order from the tension adjuster 10*a* side to the tension adjuster 10*h* side, in the direction D1 which is a direction in which the tension rollers 6 come into contact with the recording medium P. Specifically, the tension roller 6 of the tension adjuster 10*a* moves in the direction D1 by causing the rotation shaft 22 to rotate at a predetermined angle, and then the tension roller 6 of the tension adjuster 10*a* moves in a direction D2 by causing the rotation shaft 22 to rotate at a predetermined angle and the tension roller 6 of the tension adjuster 10*b* moves in the direction D1. Next, similarly, the tension roller 6 of the tension adjuster 10*b* moves in the direction D2 by causing the rotation shaft 22 to rotate at a predetermined angle and the tension roller 6 of a tension adjuster 10*c* moves in the direction D1. Such a series of operations are repeatedly performed in accordance with rotation of rotation shafts 22 at predetermined angles, by the tension adjusters 10*a* to 10*h* in order.

A rotation detecting portion 19 which can detect the rotation amount of the rotation shaft 22 is provided in an end portion of the rotation shaft 22, which is the end portion on a side opposite to the tension adjustment motor 20 side in the cross direction B. The controller 23 has a configuration in which the controller 23 controls the rotation amounts of the rotation shafts 22, in such a manner that the controller 23 can cause the tension roller 6 of a predetermined tension adjuster 10 of the plurality of tension adjusters 10 to move in the direction D1. In other words, the controller 23 has a configuration in which the controller 23 controls the rotation amounts of the rotation shafts 22 and causes the tension roller 6 of a predetermined tension adjuster 10 of the plurality of tension adjusters 10 to be pressed to the recording medium P, in such a manner that the controller 23 can cause tension to be applied to a predetermined position of the recording medium P.

The recording apparatus 1 has such a configuration, and thus, in the recording apparatus 1, the plurality of tension adjusters 10 are driven by one driving mechanism. However, the recording apparatus 1 may have a configuration in which a plurality of driving mechanism for driving the plurality of tension adjusters 10 are provided corresponding to the respective tension adjusters 10.

Next, a partial deformation reduction operation of the recording apparatus 1 when partial deformation occurs in the recording medium P due to the aspect of contact between the driven roller 7, the driving roller 5, and the recording medium P will be described.

Figure 7:
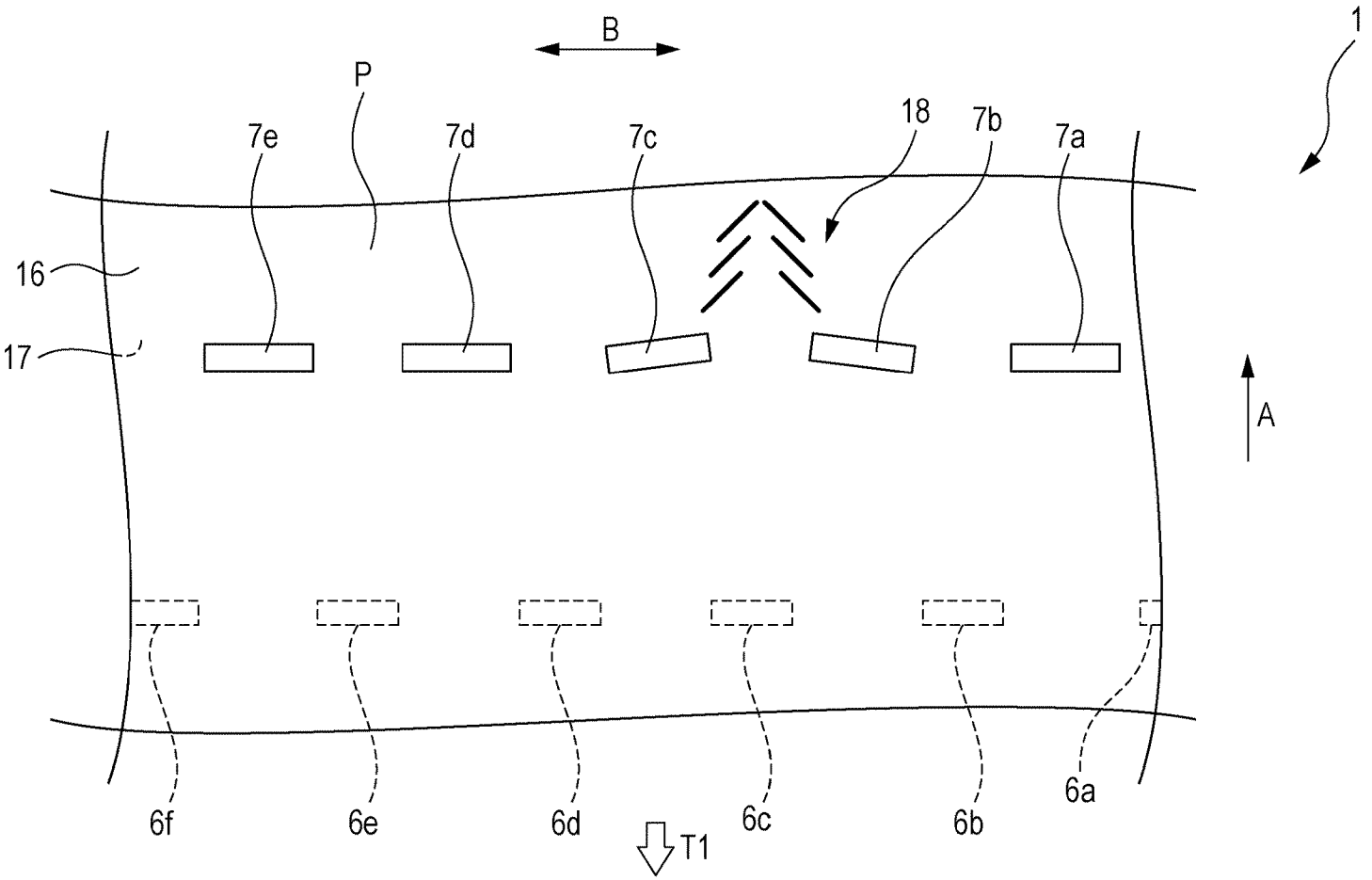
FIG. 7 is a schematic plan view illustrating a principal portion of the recording apparatus according to Example 1 of the invention.
Figure 11:
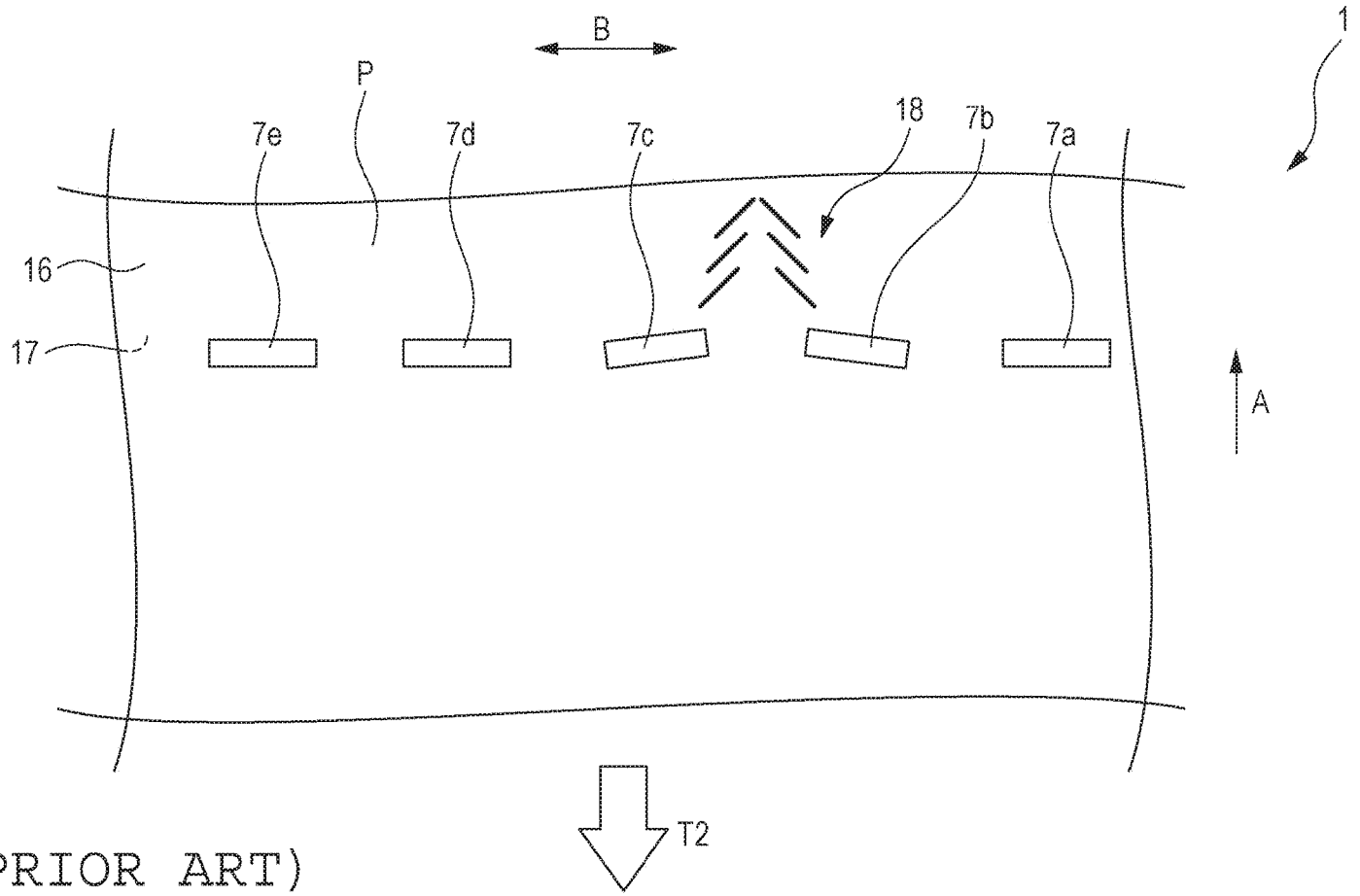
FIG. 11 is a schematic plan view illustrating a principal portion of the recording apparatus of the related art.

FIG. 7 is a schematic plan view illustrating a principal portion of the recording apparatus 1 of the example. FIG. 7 is a view illustrating a state where, in the recording apparatus 1, partial deformation (in other words, the second manifold portion 18) occurs in the recording medium P. FIG. 11 corresponds to FIG. 7 and is a schematic plan view illustrating a principal portion of the recording apparatus 1 of the related art. FIG. 11 is a view illustrating a state where, in the recording apparatus 1 of the related art, partial deformation (in other words, the second manifold portion 18) occurs in the recording medium P.

FIG. 7 illustrates a case in which, in the recording apparatus 1 of the example, the wrinkle 18 as the partial deformation occurs in the portion between driven rollers 7*b* and 7*c* of the driven rollers 7. In such a case, the sensor 13 of the recording apparatus 1 of the example detects the generation and the position of the wrinkle 18. A tension roller 6*c* of the plurality of tension rollers 6 corresponding to the plurality of tension adjusters 10, which is the tension roller located at a position corresponding to the wrinkle in the transporting direction A, is pressed to the surface 17 side of the recording medium P in accordance with the control of the controller 23, in such a manner that tension is applied to the recording medium P. In the recording apparatus 1 of the example, the driven roller 7 and the tension roller 6 are disposed in a state where, when seen from the transporting direction A, the driven roller 7 and the tension roller 6 are located at different positions (do not overlap). Furthermore, when the wrinkle 18 occurs in the portion between the driven rollers 7, the tension roller 6 corresponding to the generation position of the wrinkle 18 in the transporting direction A can be pressed to the surface 17 of the recording medium P. Accordingly, when the generation position of the wrinkle 18 is located at a position between the driven rollers 7*c* and 7*d*, a tension roller 6*d* corresponding to the generation position is pressed to the surface 17 of the recording medium P, in such a manner that tension is applied to the recording medium P. Similarly, when the generation position of the wrinkle 18 is located at a position between driven rollers 7*d* and 7*e*, a tension roller 6*e* corresponding to the generation position is pressed to the surface 17 side of the recording medium P, in such a manner that tension is applied to the recording medium P.

In this case, the extent of back tension T1 applied to the recording medium P is small because tension is applied, by the tension adjuster 10, to only a part of the recording medium P.

Meanwhile, FIG. 11 illustrates a case in which, in the recording apparatus 1 of the related art, the wrinkle 18 as the partial deformation occurs in a portion between the driven rollers 7*b* and 7*c* of the driven rollers 7. In such a case, it is difficult for the recording apparatus 1 of the related art to smooth the wrinkle 18. Furthermore, even when, in the recording apparatus 1 of the related art, the wrinkle 18 is smoothed, it is necessary for the recording apparatus 1 of the related art to apply back tension T2 to the entirety of the recording medium P in the width direction (corresponding to the cross direction B), in order to smooth the wrinkle 18. As a result, it is necessary to set the extent of the back tension T2 applied to the recording medium P to be large. When the extent of back tension applied to the recording medium P is set to be large, it is easy for the driven roller 7 to slip with respect to the recording medium P during transporting of the recording medium P. As a result, transport accuracy is reduced.

In other words, it is possible to say that, in the recording apparatus 1 of the related art, it is not possible to smooth deformation occurring in the recording medium P without a reduction in the transport accuracy of the recording medium P. However, it is possible to say that, in the recording apparatus 1 of the example, it is possible to smooth deformation occurring in the recording medium P without a reduction in the transport accuracy of the recording medium P.

Next, an electrical configuration of the recording apparatus 1 of the example will be described.

Figure 8:
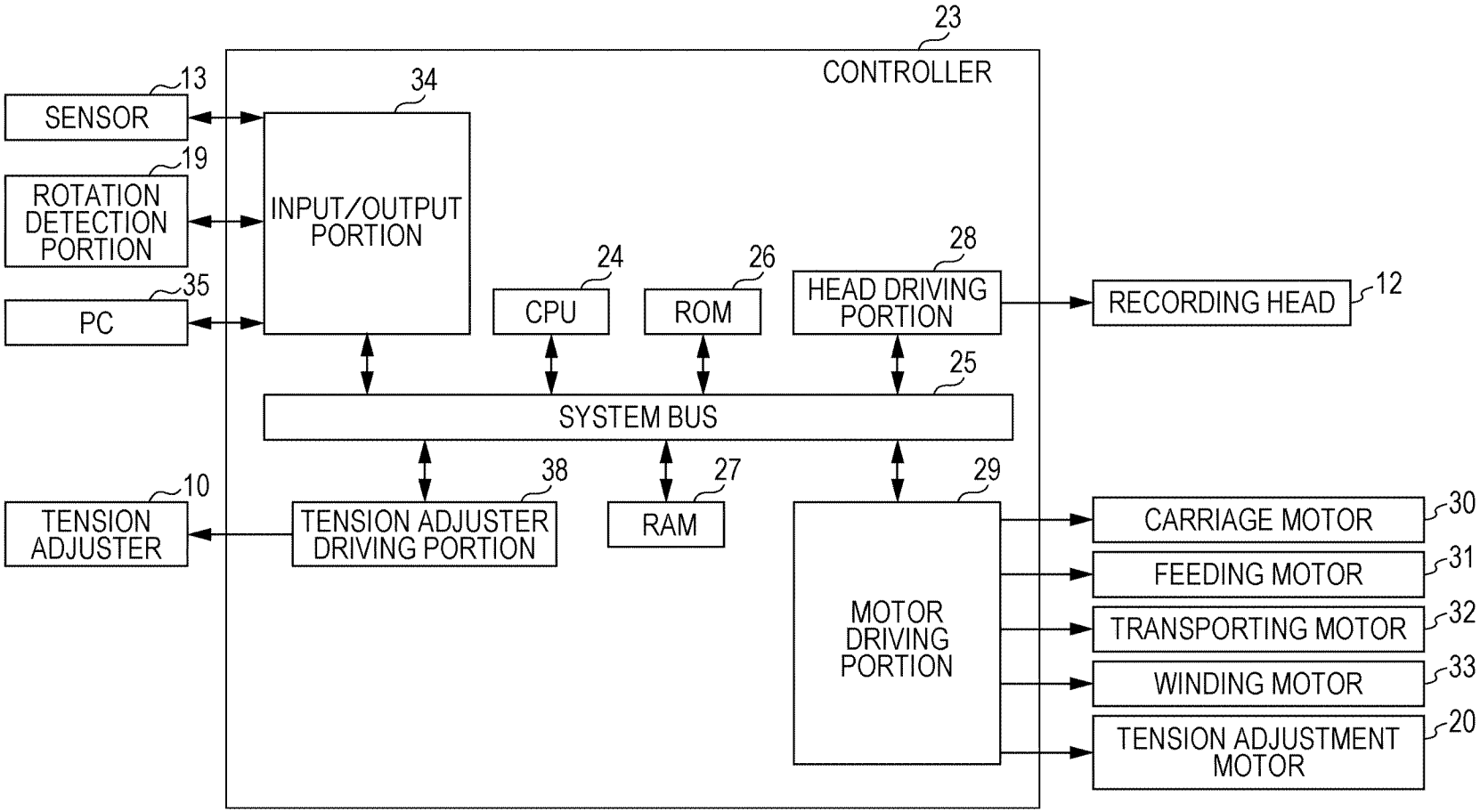
FIG. 8 is a block diagram illustrating the recording apparatus according to Example 1 of the invention.

FIG. 8 is a block diagram of the recording apparatus 1 of the example.

A CPU 24 is provided in the controller 23 to manage control of the entirety of the recording apparatus 1. The CPU 24 is connected to a ROM 26 and a RAM 27 through the system bus 25. Various control programs executed by the CPU 24 are stored in the ROM 26. The RAM 27 can temporarily store data.

Furthermore, the CPU 24 is connected, via the system bus 25, to a head driving portion 28 for driving the recording head 12.

The CPU 24 is connected, via the system bus 25, to a tension adjuster driving portion 38 for driving the tension adjuster 10.

The CPU 24 is connected, via the system bus 25, to a motor driving portion 29 for driving the tension adjustment motor 20, a carriage motor 30 for moving the carriage 11, a feeding motor 31 as a driving source of the set portion 14, a transporting motor 32 as a driving source of the driving roller 5, and a winding motor 33 as a driving source of the winding portion 15.

The CPU 24 is connected, via the system bus 25, to an input/output portion 34. The input/output portion 34 is connected to the sensor 13, a rotation detecting portion 19, and a PC 35 which is an external unit through which recording data and the like are input to the recording apparatus 1.

The tension adjuster 10 of the example is configured so that the tension adjuster 10 can apply tension of various amounts to the recording medium P in accordance to the control of the controller 23. In other words, in the tension adjuster 10 of the recording apparatus 1 of the example, the extent of the tension applied to the recording medium P is controlled, by the control of the controller 23, in accordance with a detection result of the sensor 13. Accordingly, in a case where, even when deformation occurs in the recording medium P and tension is adjusted by the tension adjuster 10, the deformation in the recording medium P is not sufficiently removed, the tension of a larger extent can be applied to the recording medium P. As a result, the deformation in the recording medium P due to the driven roller 7 and the driving roller 5 is more effectively removed.

The transporting portion 9 repeats moving and stopping of the recording medium P in accordance with the control of the controller 23, in such a manner that the transporting portion 9 can perform intermittent transporting of the recording medium P subjected to transporting. Furthermore, the tension adjuster 10 is controlled by the controller 23 and applies tension to the recording medium P at the time of stopping of the recording medium P during the intermittent transporting. Accordingly, tension is applied to the recording medium P at the time of a movement of the recording medium P during the intermittent transporting, in such a manner that a reduction in the transport accuracy is prevented.

In the recording apparatus 1 of the example, the recording medium P is transported by the set portion 14 and the winding portion 15, in a state where tension is applied to the recording medium P in the transporting direction A. In the configuration in which the recording medium P is transported in a state where tension is applied to the recording medium P in the transporting direction A, as described above, the effect of removing the deformation 18 due to application of tension to the recording medium P by the tension adjuster 10 is large. Accordingly, the wrinkle 18 of the recording medium P due to the transporting portion 9 is effectively removed.

Example 2

Figure 9:
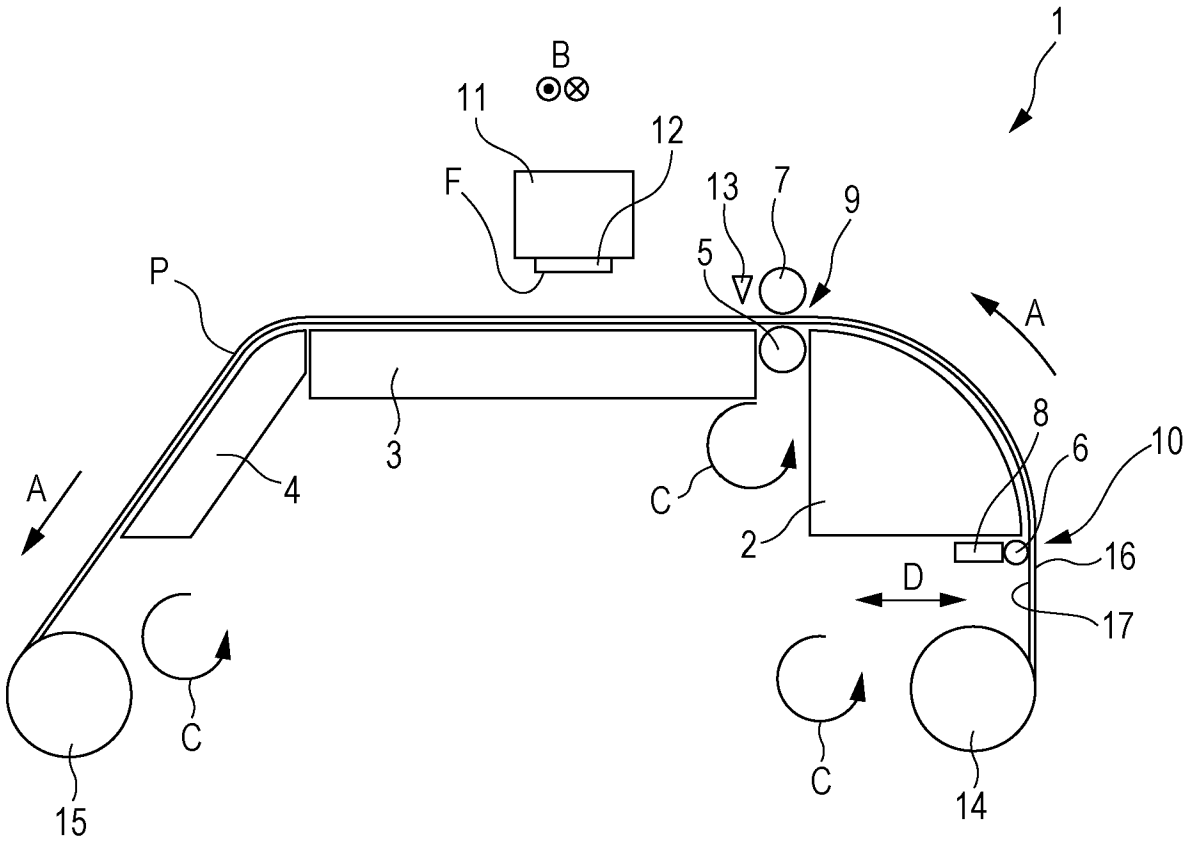
FIG. 9 is a schematic side view illustrating a recording apparatus according to Example 2 of the invention.

See FIG. 9

Next, details of a recording apparatus of an example 2 will be described with reference to the accompanying drawings.

FIG. 9 is a schematic side view illustrating the recording apparatus 1 of the example. The same reference numerals and letters are given to components of which the configurations are the same as those of the example 1 described above. Specific descriptions thereof will not be repeated.

Furthermore, the recording apparatus 1 of the example and the recording apparatus 1 of the example 1 have the same configuration, except for the configuration of the tension adjuster 10.

The tension adjuster 10 of the example 1 is configured so that the tension roller 6 moves in the direction D in relation to the base portion 8, in such a manner that the tension roller 6 comes into contact with or separates from the recording medium P. However, in the tension adjuster 10 of the example, the tension roller 6 is always in contact with the surface 17 of the recording medium P, in a state where the recording medium P is set to the recording apparatus 1. In other words, the tension roller 6 maintains a state where the tension roller 6 is in contact with the surface 17 of the recording medium P and moves in the direction D, in such a manner that a pushing amount of the tension adjuster 10 in a state where the tension adjuster 10 is in contact with the recording medium P and presses the recording medium P changes. In addition, the recording apparatus 1 of the example has a configuration in which the deformation of the recording medium P is removed by changing the pushing amount of a desired tension adjuster 10 of the plurality of tension adjusters 10, which is in a state where the desired tension adjuster 10 is in contact with the recording medium P and pushes the recording medium P.

Example 3

Figure 10:
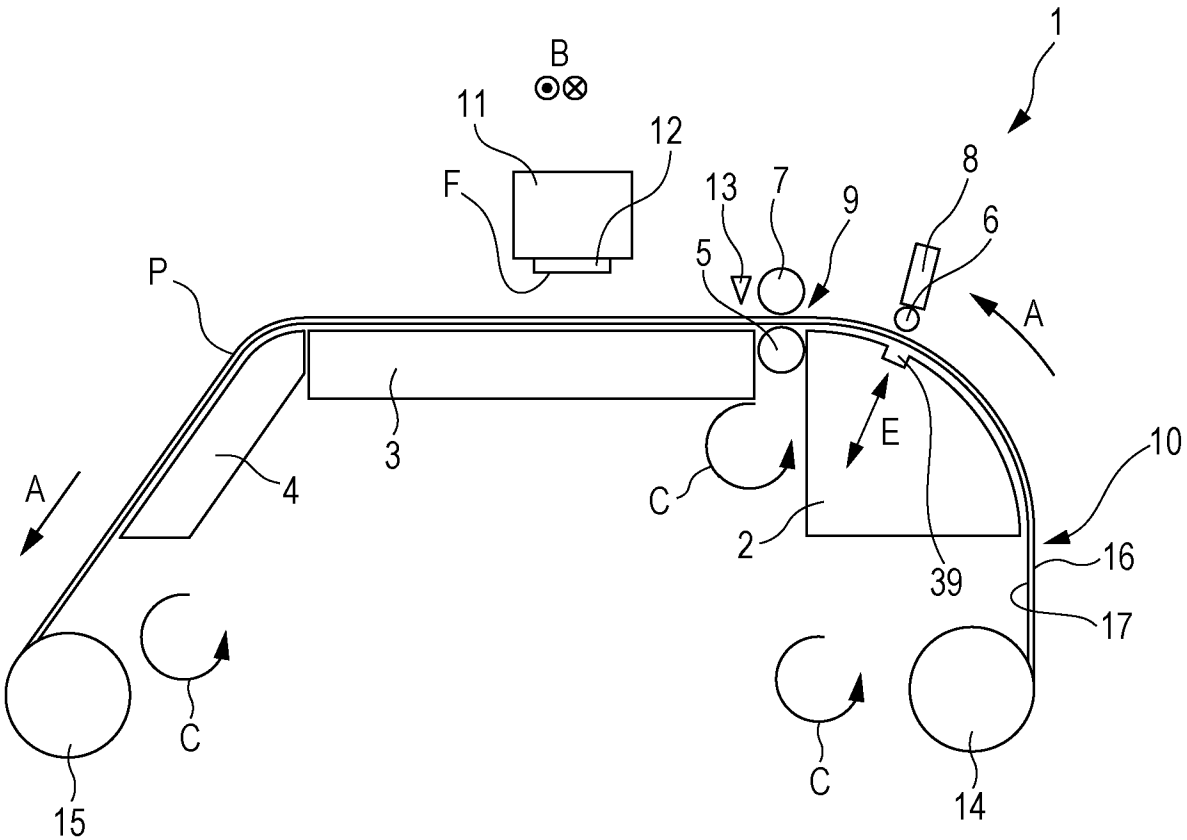
FIG. 10 is a schematic side view illustrating a recording apparatus according to Example 3 of the invention.

See FIG. 10

Next, details of a recording apparatus of an example 3 will be described with reference to the accompanying drawings.

FIG. 10 is a schematic side view illustrating the recording apparatus 1 of the example. The same reference numerals and letters are given to components of which the configurations are the same as those of the examples 1 and 2 described above. Specific descriptions thereof will not be repeated.

The recording apparatus 1 of the example and the recording apparatuses 1 of the examples 1 and 2 have the same configuration, except for the configuration of the tension adjuster 10.

The recording apparatuses 1 of the examples 1 and 2 have a configuration in which tension is applied to the surface 17 side of the recording medium P. However, the recording apparatus 1 of the example has a configuration in which tension is applied to the recording surface 16 side of the recording medium P. Specifically, the tension roller 6 moves in a direction E toward a hole portion 39 provided in the platen 2 and the tension roller 6 comes into contact with or separates from the recording medium P, in such a manner that tension can be applied to the recording surface 16 side of the recording medium P.

The recording apparatus 1 of the example has a configuration in which the recording apparatus 1 can perform recording on the recording medium P of a roll shape. However, the configuration thereof is not limited thereto. The recording apparatus 1 has a configuration in which the recording apparatus 1 can perform recording on the recording medium P of a cut-sheet shape. When the recording apparatus 1 has a configuration in which the recording apparatus 1 can perform recording on the recording medium P of the cut-sheet shape, a member, such as a so-called paper feeding (sending) tray and a paper feeding (sending) cassette, may be used as the set portion 14 of the recording medium P. Furthermore, a member, such as a so-called a discharge receiving portion, a discharged paper (discharge) tray, and a discharged paper (discharge) cassette, may be used, as a recovery portion other than the winding portion 15, as a recovery portion in relation to the recording medium P.

Needless to say, the invention is not intended to be limited to examples described above. The invention can be used in various ways as long as those do not depart from the scope of the invention described in the claims and those are also included in the scope of the invention.

Hereinbefore, the details of the examples of the invention are described. Here, the summary of the invention will be described.

The recording apparatus 1 according to a first aspect of the invention includes the recording portion 12 which can perform recording, the transporting portion 9 which transports the medium P by coming into contact with the medium P and is provided in the area upstream from the recording portion 12 in the transporting direction A of the medium P, and the plurality of tension adjusters 10 which are provided in the cross direction B crossing the transporting direction A and each of which can apply tension to the medium P from at least either the recording surface 16 side or the non-recording surface 17 side opposite to the recording surface 16 of the medium P.

In this case, the plurality of tension adjusters 10 are provided in the cross direction B and each tension adjuster 10 can apply tension to the medium P from at least either the recording surface 16 side or the surface 17 side of the medium P. Accordingly, tension adjustment is separately performed by the plurality of tension adjusters 10, in accordance with the generation position of the partial deformation 18 due to the aspect of contact between the transporting portion 9 and the medium P. As a result, the deformation 18 of the medium P due to the transporting portion 9 can be removed.

The recording apparatus 1 according to a second aspect of the invention further includes the controller 23 which controls application of tension to the medium P by the tension adjuster 10.

In this case, the controller 23 which controls application of tension to the medium P by the tension adjuster 10 is provided. Thus, the deformation 18 of the medium P due to the transporting portion 9 can be automatically removed.

The recording apparatus 1 according to a third aspect of the invention is configured so that the tension adjuster 10 can come into contact with or separate from the medium P.

In this case, the deformation 18 of the medium P due to the transporting portion 9 can be removed by the tension adjuster 10 which can come into contact with or separate from the medium P.

In the recording apparatus 1 according to a fourth aspect of the invention, the tension adjuster 10 has a configuration in which a pushing amount of the tension adjuster 10 in a state where the tension adjuster 10 is in contact with the medium P and pushes the medium P can change.

In this case, the deformation 18 of the medium P due to the transporting portion 9 can be removed by the tension adjuster 10 in which the pushing amount of the tension adjuster 10 in a state where the tension adjuster 10 is in contact with the medium P and pushes the tension adjuster 10 can change.

In the recording apparatus 1 according to a fifth aspect of the invention, the tension adjuster 10 applies tension to the medium P from the non-recording surface 17 side.

In this case, the tension adjuster 10 applies tension to the medium P from the non-recording surface 17 side. Accordingly, the tension adjuster 10 can be prevented from coming into contact with the recording surface 16 and damaging the recording surface 16 and, further, the deformation 18 of the medium P due to the transporting portion 9 can be removed.

In the recording apparatus 1 according to a sixth aspect of the invention, the tension adjuster 10 is provided in the area upstream from the transporting portion 9 in the transporting direction A.

When the tension adjuster 10 is provided in an area downstream from the transporting portion 9 in the transporting direction A, there is a concern that the PG may change due to lifting of the medium P in accordance with application of tension to the medium P by the tension adjuster 10. However, in this case, the tension adjuster 10 is provided in the area upstream from the transporting portion 9 in the transporting direction A. As a result, lifting of the medium P is suppressed by, for example, the transporting portion 9, in such a manner that a change in the PG can be prevented and the deformation 18 of the medium P due to the transporting portion 9 can be prevented.

The recording apparatus 1 according to a seventh aspect of the invention further includes the detecting portion 13 which is located in the area downstream from the transporting portion 9 and upstream from the recording portion 12 in the transporting direction A and detects deformation 18 of the medium P.

In this case, the detecting portion 13 detecting the deformation 18 of the medium P is provided in the area downstream from the transporting portion 9 and upstream from the recording portion 12 in the transporting direction A. Accordingly, the deformation 18 of the medium P is detected by the detecting portion 13, and thus the position of the deformation of the recording medium P is automatically checked without, for example, visual inspection of a user before the deformed portion reaches the recording portion 12.

In the recording apparatus 1 according to an eighth aspect of the invention, the tension adjuster 10 can apply tension of various amounts to the medium P.

In this case, the tension adjuster 10 can apply tension of various amounts to the medium P. Accordingly, in a case where, even when the deformation 18 occurs in the medium P and tension is adjusted by the tension adjuster 10, the deformation 18 of the medium P is not sufficiently removed, tension of a larger extent can be applied to the medium P. As a result, the deformation 18 of the recording medium P due to the transporting portion 9 can be more effectively removed.

The recording apparatus 1 according to a ninth aspect of the invention further includes the controller 23 which controls application of tension to the medium P by the tension adjuster 10 and the detecting portion 13 which is located in the area downstream from the transporting portion 9 and upstream from the recording portion 12 in the transporting direction A and detects deformation 18 of the medium P, in which the tension adjuster 10 can apply tension of various amounts to the medium P and the controller 23 controls the extent of tension applied to the medium P by the tension adjuster 10, in accordance with the detection result of the detecting portion 13.

In this case, the controller 23 controls the extent of tension applied to the medium P by the tension adjuster 10, in accordance with the detection result of the detecting portion 13. Accordingly, in a case where, even when the deformation 18 occurs in the medium P and tension is adjusted by the tension adjuster 10, the deformation 18 of the medium P is not sufficiently removed, for example, tension of a larger extent can be automatically applied to the medium P.

In the recording apparatus 1 according to a tenth aspect of the invention, the transporting portion 9 can perform intermittent transporting of the medium P subjected to transporting by repeating moving and stopping of the medium P. Furthermore, the controller 23 controls the tension adjuster 10 so that the tension adjuster 10 applies tension to the medium P at the time of stopping of the medium P during the intermittent transporting.

In this case, the controller 23 controls the tension adjuster 10 so that the tension adjuster 10 applies tension to the medium P at the time of stopping of the medium P during the intermittent transporting. Accordingly, tension is applied to the medium P at the time of moving of the medium P during the intermittent transporting, and thus a reduction in the transport accuracy can be prevented.

In the recording apparatus 1 according to an eleventh aspect of the invention, the medium P is transported in a state where tension is applied to the medium P in the transporting direction.

In this case, the medium P is transported in a state where tension is applied to the medium P in the transporting direction. In the configuration in which the medium P is transported in a state where tension is applied to the medium P in the transporting direction, the effect of removing the deformation 18 due to application of tension to the medium P by the tension adjuster 10 is large. As a result, the deformation 18 of the medium P due to the transporting portion 9 can be effectively removed.

The entire disclosure of Japanese Patent Application No. 2014-161034 filed Aug. 7, 2014 is expressly incorporated by reference herein.

What is claimed is:

1. A recording apparatus comprising:

a recording portion configured to record on a medium transported in a transporting direction;

a transporting portion which transports the medium and is provided in an area upstream from the recording portion in the transporting direction of the medium, the transporting portion including at least three rollers spaced apart from each other and aligned in a row substantially perpendicular to the transporting direction;

a detecting portion which is located in an area downstream from the transporting portion and upstream from the recording portion in the transporting direction and detects partial deformation of the medium occurring in a space between two adjacent rollers; and a plurality of tension adjusters including at least one tension adjuster being disposed completely within a width of the medium, the plurality of tension adjusters being spaced apart from each other, aligned in a row substantially perpendicular to the transporting direction, and offset from the at least three rollers, each of the plurality of tension adjusters being configured to apply tension to the medium from at least either a recording surface side or a non-recording surface side opposite to the recording surface of the medium to smooth the detected partial deformation.

2. The recording apparatus according to claim 1, further comprising:

a controller which controls application of tension to the medium by the plurality of tension adjusters.

3. The recording apparatus according to claim 2, wherein the transporting portion is configured to intermittently transport the medium by repeating moving and stopping of the medium, and wherein the controller controls the plurality of tension adjusters to apply tension to the medium when the medium is stopped during the intermittent transporting.

4. The recording apparatus according to claim 1, wherein each of the plurality of tension adjusters is configured to independently move between a position in contact with the medium and a position separated from the medium.

5. The recording apparatus according to claim 1, wherein the tension applied by the plurality of tension adjusters to the medium is adjustable.

6. The recording apparatus according to claim 1, wherein the plurality of tension adjusters applies tension to the medium from the non-recording surface side.

7. The recording apparatus according to claim 1, wherein the plurality of tension adjusters is provided in an area upstream from the transporting portion in the transporting direction.

8. The recording apparatus according to claim 1, further comprising:

a controller which controls application of tension to the medium by the plurality of tension adjusters; and wherein the plurality of tension adjusters is configured to apply tension of various amounts to the medium, and wherein the controller controls an extent of tension applied to the medium by the plurality of tension adjusters, in accordance with a detection result of the detecting portion.

9. The recording apparatus according to claim 1, wherein the medium is transported in a state where tension is applied to the medium in the transporting direction.

10. The recording apparatus according to claim 1, wherein the plurality of tension adjusters is at least three, and the at least three tension adjusters are aligned in a non-overlapping relationship with the at least three rollers.

11. The recording apparatus according to claim 1, wherein the transporting portion is located in an area downstream from the plurality of tension adjusters and upstream from the detecting portion in the transporting direction.

12. A recording apparatus comprising:

a recording portion configured to record on a medium transported in a transporting direction;

a transporting portion which transports the medium and is provided in an area upstream from the recording portion in the transporting direction of the medium;

a detecting portion which is located in an area downstream from the transporting portion and upstream from the recording portion in the transporting direction and detects partial deformation of the medium;

a plurality of tension adjusters spaced apart from each other and aligned in a row substantially perpendicular to the transporting direction, the plurality of tension adjusters being configured to apply tension to the medium from at least either a recording surface side or a non-recording surface side opposite to the recording surface of the medium;

a controller which controls application of tension to the medium by the plurality of tension adjusters;

wherein each of the plurality of tension adjusters is configured to independently move between a position in contact with the medium and a position separated from the medium, and wherein at least one of the plurality of tension adjusters is disposed completely within a width of the medium.

* * * * *